US006534450B1

(12) United States Patent
Harrison et al.

(10) Patent No.: US 6,534,450 B1
(45) **Date of Patent: *Mar. 18, 2003**

(54) DISPERSED HYDRATED SODIUM BORATE COMPOSITIONS HAVING IMPROVED PROPERTIES IN LUBRICATING OIL COMPOSITIONS

(75) Inventors: James J. Harrison, Novato, CA (US); Kenneth D. Nelson, Clear Lake, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/967,050

(22) Filed: Sep. 28, 2001

(51) Int. Cl.[7] ..... C10M 125/26; C10M 125/00

(52) U.S. Cl. ..... 508/158; 508/156; 508/306; 508/287; 508/390

(58) Field of Search ..... 508/156, 158, 508/306, 390

(56) References Cited

U.S. PATENT DOCUMENTS 3,313,727 A * 4/1967 Peeler ..... 508/156
3,489,619 A * 1/1970 Brewster ..... 148/637
3,819,521 A * 6/1974 Sims ..... 508/160
3,853,772 A * 12/1974 Adams ..... 508/156
3,912,643 A * 10/1975 Adams ..... 508/156
3,997,454 A * 12/1976 Adams ..... 508/156
4,089,790 A * 5/1978 Adams ..... 508/156
4,163,729 A * 8/1979 Adams ..... 508/156
4,253,977 A * 3/1981 O'Halloran ..... 508/270
4,263,155 A * 4/1981 Frost ..... 508/156
4,384,967 A * 5/1983 Salentine et al. ..... 508/156
4,401,580 A * 8/1983 Frost ..... 508/160
4,472,288 A * 9/1984 Frost, Jr. ..... 508/159
4,584,873 A * 4/1986 Ongaro ..... 73/146
4,778,614 A * 10/1988 Rawlinson et al. ..... 508/195
5,389,271 A * 2/1995 Lundberg et al. ..... 508/390
5,523,417 A * 6/1996 Blackborow et al. ..... 549/233
5,972,852 A * 10/1999 Robson ..... 508/306

* cited by examiner

*Primary Examiner*—Ellen M. McAvoy
(74) *Attorney, Agent, or Firm*—Joseph P. Foley; Claude J. Caroli

(57) ABSTRACT

Disclosed are dispersed hydrated sodium borate compositions, as well as additive packages and finished oil compositions comprising the same. The dispersed hydrated sodium borate compositions of this invention exhibit decreased turbidity and the finished oil compositions improved water tolerance when the hydroxyl to boron ratio is carefully controlled.

14 Claims, 2 Drawing Sheets

DISPERSED HYDRATED SODIUM BORATE COMPOSITIONS HAVING IMPROVED PROPERTIES IN LUBRICATING OIL COMPOSITIONS

FIELD OF THE INVENTION

This invention is directed, in part, to novel dispersed hydrated sodium borate compositions, as well as additive packages and finished oil compositions comprising the same. The dispersed hydrated sodium borate compositions of this invention exhibit decreased turbidity over conventional dispersed hydrated sodium borate compositions and show good compatibility with additives typically used in fully formulated gear oil compositions. The finished oil compositions comprising such dispersed hydrated sodium borate compositions exhibit improved water tolerance with good storage stability.

This invention is also directed, in part, to methods for decreasing the turbidity of dispersed hydrated sodium borate compositions, and for improving the water tolerance of finished oil compositions comprising such dispersed hydrated sodium borate compositions.

REFERENCES

The following references are cited in this application as superscript numbers:

[1] Peeler, U.S. Pat. No. 3,313,727, Alkali Metal Borate E.P. Lubricants, issued Apr. 11, 1967

[2] Adams, U.S. Pat. No. 3,912,643, Lubricant Containing Neutralized Alkali Metal Borates, issued Oct. 14, 1975

[3] Sims, U.S. Pat. No. 3,819,521, Lubricant Containing Dispersed Borate and a Polyol, issued Jun. 25, 1974

[4] Adams, U.S. Pat. No. 3,853,772, Lubricant Containing Alkali Metal Borate Dispersed with a Mixture of Dispersants, issued Dec. 10, 1974

[5] Adams, U.S. Pat. No. 3,997,454, Lubricant Containing Potassium Borate, issued Dec. 14, 1976

[6] Adams, U.S. Pat. No. 4,089,790, Synergistic Combinations of Hydrated Potassium Borate, Antiwear Agents, and Organic Sulfide Antioxidants, issued May 16, 1978

[7] Adams, U.S. Pat. No. 4,163,729, Synergistic Combinations of Hydrated Potassium Borate, Antiwear Agents, and Organic Sulfide Antioxidants, issued Aug. 7, 1979

[8] Frost, U.S. Pat. No. 4,263,155, Lubricant Composition Containing an Alkali Metal Borate and a Sulfur-Containing Polyhydroxy Compound, U.S. Pat. No. 5,461,184, issued Oct. 24, 1995

[9] Frost, U.S. Pat. No. 4,401,580, Lubricant Composition Containing an Alkali Metal Borate and an Ester-Polyol Compound, issued Aug. 30, 1983

[10] Frost, U.S. Pat. No. 4,472,288, Lubricant Composition Containing an Alkali Metal Borate and an Oil-Soluble Amine Salt of a Phosphorus Compound, issued Sep. 18, 1984

[11] Clark, U.S. Pat. No. 4,584,873, Automotive Friction Reducing Composition, issued Aug. 13, 1985

[12] Brewster, U.S. Pat. No. 3,489,619, Heat Transfer and Quench Oil, issued Jan. 13, 1970.

All of the above references are herein incorporated by reference in their entirety to the same extent as if each individual publication or patent was specifically and individually indicated to be incorporated by reference in its entirety.

STATE OF THE ART

High load conditions often occur in gear sets such as those used in automobile transmissions and differentials, pneumatic tools, gas compressors, centrifuges, high-pressure hydraulic systems, metal working and similar devices, as well as in many types of bearings. When employed in such environments, it is conventional to add an extreme-pressure (E.P.) agent to the lubricant composition and, in this regard, alkali metal borates are well known extreme-pressure agents for such compositions.[1-11] E.P. agents are added to lubricants to prevent destructive metal-to-metal contact in the lubrication of moving surfaces. While under normal conditions termed "hydrodynamic", a film of lubricant is maintained between the relatively moving surfaces governed by lubricant parameters, and principally viscosity. However, when load is increased, clearance between the surfaces are reduced, or when speeds of moving surfaces are such that the film of oil cannot be maintained, the condition of "boundary lubrication" is reached; governed largely by the parameters of the contacting surfaces. At still more severe conditions significant destructive contact manifests itself in various forms such as welding, scoring, scuffing, ridging, rippling or cleavage. It is the role of E.P. additives to prevent this from happening. For the most part, E.P. agents have been oil soluble or easily dispersed as a stable dispersion in the oil, and largely have been organic compounds chemically reacted to contain sulfur, halogen (principally chlorine), phosphorous, carboxyl, or carboxylate salt groups which react with the metal surface under boundary lubrication conditions. Stable dispersions of hydrated metal borates have also been found to be effective as E.P. agents.

Because hydrated alkali metal borates are insoluble in lubricant oil media, it is necessary to incorporate the borate as a dispersion in the oil and homogenous dispersions are particularly desirable. The degree of formation of a homogenous dispersion can be correlated to the turbidity of the oil after addition of the hydrated alkali metal borate with higher turbidity correlating to less homogenous dispersions. In order to facilitate formation of such a homogenous dispersion, it is conventional to include a dispersant in such compositions. Examples of dispersants include lipophilic surface-active agents such as alkenyl succinimides or other nitrogen containing dispersants as well as alkenyl succinates.[1-4, 12] It is also conventional to employ the alkali metal borate at particle sizes of less than 1 micron in order to facilitate the formation of the homogenous dispersion.[11]

Of the hydrated alkali metal borates heretofore used, hydrated potassium borates were conventionally employed. The hydrated potassium borate compositions, additive packages, and lubricant compositions comprising such borates often had unacceptably high turbidity when added to lubricant compositions.

In addition, the hydrated potassium borate compositions, additive packages and lubricant compositions comprising hydrated potassium borates often had poor water tolerance. Such intolerance was reflected by the formation of borate crystals that generally separate from the oil phase to form deposits that can damage the elastomer seals in various engine parts and cause leakage.

In view of the above, further reductions in turbidity and further improvements in water tolerance for oil compositions comprising a sodium borate would be particularly beneficial.

SUMMARY OF THE INVENTION

This invention is directed to the novel and unexpected discovery that the turbidity arising from the preparation of a dispersed hydrated sodium borate composition can be reduced by specifically controlling the degree of dehydration of the boron in the dispersion.

In addition, this invention is directed to the novel and unexpected discovery that the water tolerance of dispersed hydrated sodium borates is improved by carefully controlling the ratio of sodium to boron and the degree of dehydration in the composition.

Accordingly, in one of its composition aspects, this invention is directed to a dispersed hydrated sodium borate composition comprising a hydrated sodium borate, a dispersant, optionally a detergent, and an oil of lubricating viscosity wherein said hydrated sodium borate is characterized by a hydroxyl:boron ratio (OH:B) of from about 0.80:1 to 1.60:1 and by a sodium to boron ratio of from about 1:2.75 to 1:3.25.

In one preferred embodiment, the dispersed sodium borate compositions described herein have a turbidity of less than about 75 ntu, more preferably, less than about 60 ntu, and still more preferably, less than about 40 ntu.

In another preferred embodiment, the dispersed hydrated sodium borate composition has a sodium to boron metal ratio of from about 1:2.9 to about 1:3.1 and more preferably about 1:3.

In still another preferred embodiment, the hydroxyl:boron ratio is from about 0.90:1 to 1.50:1, more preferably 1.00:1 to 1.40:1.

In yet another preferred embodiment, the hydrated sodium borate has an average particle size of less than about 0.3 microns and more preferably from about 0.10 to about 0.20 microns.

Preferably, the dispersed sodium borate compositions contain small amounts of a water-soluble oxo anion. Only from 0.001 moles to 0.11 moles of water soluble oxo anion should be present per mole of boron. This water-soluble oxo anion can include nitrate, sulfate, carbonate, phosphate, pyrophosphate, silicate, aluminate, germanate, stannate, zincate, plumbate, titanate, molybdate, tungstate, vanadate, niobate, tantalate, uranates, or can include the isopolymolybdates and isopolytungstates, or the hetcropolymolybdates and heteropolytungstates, or mixtures thereof.

Preferably the dispersant in said sodium borate compositions is selected from the group consisting of a polyalkylene succinimide, a polyalkylene succinic anhydride, a polyalkylene succinic acid, a mono- or di-salt of a polyalkylene succinic acid and mixtures thereof. Preferably, the dispersed sodium borate composition contains a detergent such as a metal sulfonate, preferably an alkylaromatic or polyisobutenyl calcium sulfonate which acts in these compositions to help provide for a homogeneous dispersion.

Another aspect of this invention is directed to additive packages comprising from about 10 to 75 weight percent of the dispersed hydrated sodium borate composition described above and from about 90 to 15 weight percent of one or more of conventional additives selected from the group consisting of ashless dispersants (0–5%), detergents (0–2%), sulfurized hydrocarbons (0–30%), dialkyl hydrogen phosphates (0–10%), zinc dithiophosphates (0–20%), pentaerythritol monooleate (0–10%), 2,5-dimercaptothiadiazole (0–5%), benzotriazole (0–5%), dispersed molybdenum disulfide (0–5%), foam inhibitors (0–2%), and imidazolines (0–10%) and the like wherein each weight percent is based on the total weight of the composition. It is understood of course, that the addition of such conventional additives will dilute the concentration of the hydrated sodium borate, dispersant and oil of lubricating viscosity in the dispersed hydrated sodium borate composition.

Such additive packages can be added in effective amounts to an oil of lubricating viscosity to form a finished oil composition. Accordingly, the finished oil compositions of this invention contain the additive packages as described above upon further blending with an oil of lubricating viscosity. Preferably, the additive package described above, in an amount of from about 5 to 15 weight percent, is added to an oil of lubricating viscosity, in the amount of from about 85 to 95 weight percent, to provide for the finished gear oil composition wherein the weight percent of each component is based on the total weight of the composition. More preferably, added along with the oil of lubricating viscosity is a polymethacrylate viscosity index improver which is included at a level of 0–12% and/or a pour point depressant at a level of 0–1%, to form a finished oil wherein the weight percent of each of the viscosity index improver and pour point depressant is based on the total weight of the composition.

This invention is also directed to a method for providing lower turbidity for dispersed hydrated sodium borate compositions which method comprises carefully controlling the hydroxyl:boron ratio (OH:B) of the dispersed hydrated sodium borate in the range of from about 0.80:1 to 1.60:1 and a sodium to boron ratio of from about 1:2.75 to 1:3.25.

This invention is still further directed to a method for preparation of such dispersed sodium borate compositions which comprises:

mixing, under agitation, a mixture of an aqueous solution of boric acid and sodium hydroxide, where the stoichiometric ratio of the boric acid and the sodium hydroxide are selected to provide for a sodium to boron ratio in the product of from about 1:2.75 to 1:3.25, with an oil of lubricating viscosity and a dispersant, and then heating the mixture to remove sufficient water so as to produce a dispersed hydrated sodium borate having a OH:B ratio of from about 0.80:1 to about 1.60:1.

BRIEF DESCRIPTION OF THE DRAWING

The invention will be better understood with the aid of the appended drawings in which.

DETAILED DESCRIPTION OF THE INVENTION

Figure 1:
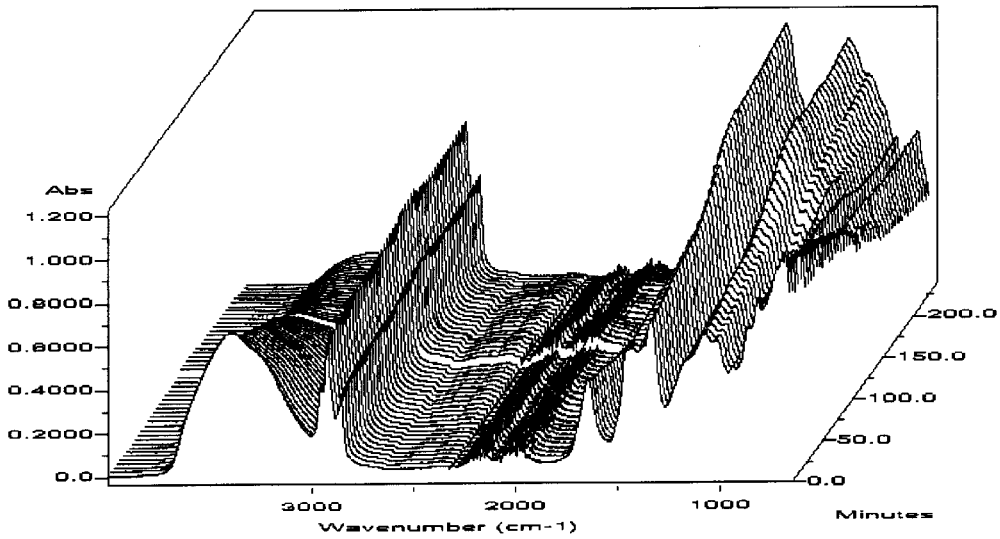
FIG. 1 represents overlaid infra-red spectra for a hydrated sodium borate of this invention.

This invention is directed, in part, to novel dispersed hydrated sodium borate compositions comprising a hydrated sodium borate, a dispersant, optionally a detergent, and an oil of lubricating viscosity wherein said dispersed hydrated sodium borate composition is characterized by a hydroxyl:boron ratio (OH:B) of from about 0.80:1 to 1.60:1 and by a sodium to boron ratio of from about 1:2.75 to 1:3.25.

Each of these components in the claimed composition will be described in detail herein. However, prior to such a description, the following terms will first be defined.

The term "hydroxyl:boron ratio" or "OH:B" refers to a ratio of the number of hydroxyl groups attached to boron (moles of hydroxyl groups per mole of boron) in the dispersed hydrated sodium borate compositions as exemplified by, for example, structural formula I below. Another way to define the term "hydroxyl:boron ratio" is to consider the formula:

$$Na_2O\ .xB_2O_3.yH_2O$$

where x is between 2.75 and 3.25 and y is between 2.75 and 4.875, wherein the ratio of y to x is 0.80:1 to 1.60:1, this ratio of y to x is the "hydroxyl:boron ratio".

For the purposes of this application, the OH:B ratio of a hydrated sodium borate is calculated from the maximum infra-red, IR, absorbance between 3800 and 3250 $cm^{-1}$ (corrected by subtracting the baseline which is taken to be the absorbance at 3900 $cm^{-1}$) of a 5.000% solution, in a 0.215 mm transmittance cell, of the dispersed hydrated sodium borate composition in an oil of lubricating viscosity wherein all interfering absorbances due to other compounds or impurities have been subtracted. The remaining absorbance in this range corresponds to the hydroxyl groups of the dispersed sodium borate which is then converted to OH:B as follows:

$$OH:B=21.0A_{max}/\%B$$

where $A_{max}$ is the baseline corrected maximum IR absorbance (peak height)in the region 3800–3250 $cm^{-1}$; and %B is the percent boron in the original (non-diluted) dispersed sodium borate sample.

The absorbance in this range, 3800 to 3250 $cm^{-1}$ corresponds to the hydroxyl groups of the sodium borate oligomer complex. If other additives are added to mask or interfere with the absorbance within this preferred range such groups will be subtracted from the IR spectra in the initial calculation of the OH:B ratio calculation.

In the examples below, this absorbance was measured with a Nicolet 5DXB FTIR Spectrometer fitted with a DTGS detector and CsI beam splitter. The spectrometer had $CaF_2$ windows with 0.215 mm Teflon® spacer with small section cut out and a suitable cell holder. A spectrum of the sample was obtained using a 4 $cm^{-1}$ resolution.

The dispersed hydrated sodium borate composition preferably includes those compositions comprising from about 10 to 75 weight percent of the hydrated sodium borate; from about 5 to 20 weight percent of a dispersant; and from about 30 to 70 weight percent of an oil of lubricating viscosity, all based on the total weight of the composition. These compositions can be diluted to provide for an "additive package" as described above which, in turn, can be further diluted to provide for a fully formulated finished oil that is also described above.

Hydrated Sodium Borate

Hydrated sodium metal borates are well known in the art. Representative patents disclosing suitable borates and methods of manufacture include: U.S. Pat. Nos. 3,313,727; 3,819,521; 3,853,772; 3,912,643; 3,997,454; and 4,089,790.[1-6]

These sodium metal borates can generally be represented by the following theoretical structural formula I:

I

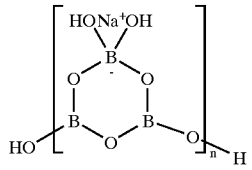

where n is a number preferably from 1.0 to about 10.

In the compositions of this invention, the specific ratio of sodium to boron is limited to a range from about 1:2.75 to 1:3.25 and the specific ratio of hydroxyl to boron is from about 0.8:1 to 1.60:1.

Dispersed alkali metal borate compositions comprising hydrated sodium metal borates are generally prepared by forming, in deionized water, a solution of sodium hydroxide and boric acid optionally in the presence of a small amount of sodium carbonate. The solution is then added to a lubricant composition comprising an oil of lubricating viscosity, a dispersant and any optional additives to be included therein (e.g., a detergent, 2,2'-thiodiethanol, and the like) to form an emulsion that is then dehydrated. Dehydration proceeds in three steps including an initial step of water removal that is initiated at a temperature of slightly over 100° C. This initial step is followed by a slow increase in temperature whereupon the emulsion changes from turbid to clear. In the final step, there is a rapid increase in temperature and the liquid once again becomes turbid.

Formation of the hydrated sodium borates described herein is achieved by stoichiometric selection of the appropriate amounts of sodium hydroxide and boric acid and control of the extent of dehydration such that the resulting product has ratio of sodium to boron range from about 1:2.75 to 1:3.25 and a ratio of hydroxyl to boron is from about 0.80:1 to 1.60:1.

The hydrated sodium borates and compositions containing them have been found to be reactive in the presence of water. The presence of water was known to alter the size, shape, and composition of the amorphous borate particles to produce a number of undesirable crystalline borates. When these hydrated sodium borates are dispersed and used in lubricant compositions these borate crystals generally separate out from the oil phase to form deposits in the oil, and can damage the elastomer seals in various engine parts and cause leakage. Therefore, some of the prior art taught the removal of substantially all the water in the preparation of such borate dispersions.[12]

In this invention, it was discovered that unexpected properties resulted when the degree of dehydration was carefully controlled to provide for a hydroxyl to boron ratio of from about 0.80:1 to 1.60:1. It was also discovered that unexpected properties resulted when the ratio of sodium to boron was carefully controlled to provide for a sodium to boron ratio of from about 1:2.75 to 1:3.25. Because of their retention of hydroxyl groups on the borate complex, these complexes are referred to as "hydrated sodium borates" and compositions containing oil/water emulsions of these hydrated sodium borates are referred to as "dispersed hydrated sodium borate compositions".

As stated above, the dehydration of the reaction mixture is closely monitored to ensure that the resulting dispersed hydrated sodium borate concentrate has a hydroxyl to boron ratio of from about 0.80:1 to 1.60:1 when the reaction mixture is ultimately returned to a temperature of about 0° C. to about 50° C. and more preferably from about 20° C. to 45° C. In addition, related to a method aspect of the present invention, the dehydration procedure is carefully controlled (i.e., using a slower dehydration rate, employing a sweep gas, and the like) in order to avoid condensation of water on the walls of the reaction chamber. Condensation can result in water droplets in the lubricant composition which, in turn, can lead to undesired precipitate formation as described above. Such precipitate formation typically results in large particles that fall from suspension and have deleterious properties as previously noted. Accordingly, in a preferred embodiment of this invention, dehydration occurs over a period of from about 1 to 10 hours, more preferably 3 to 8 hours. Optimization of the time, temperature and rate of air flow gives the preferred reaction design.

Preferred dispersed sodium borate compositions have a sodium-to-boron ratio of about 1:2.75 to 1:3.25 and more preferably 1:2.9 to about 1:3.1, and even more preferably about 1:3. In another of its preferred embodiments, the hydrated sodium borate particles generally have a mean particle size of less than 1 micron. In this regard, it has been found that the dispersed sodium borate compositions of this invention preferably have a particle size where 90% or greater of the particles are less than 0.2 microns. The dispersed hydrated sodium borate compositions of this invention have a smaller particle size distribution than commercial potassium metal dispersed hydrated borates.

In the dispersed hydrated sodium borate compositions, the hydrated sodium borates will generally comprise about 10 to 75 weight percent, preferably 25 to 50 weight percent, more preferably about 35 to 40 weight percent of the composition. (Unless otherwise stated, all percentages are in weight percent.)

Preferably, the dispersed sodium borate compositions contain small amounts of a water soluble oxo anion. Only from 0.001 moles to 0.11 moles of water soluble oxo anion should be present per mole of boron. This water-soluble oxo anion can include nitrate, sulfate, carbonate, phosphate, pyrophosphate, silicate, aluminate, germanate, stannate, zincate, plumbate, titanate, molybdate, tungstate, vanadate, niobate, tantalate, uranates, or can include the isopolymolybdates and isopolytungstates, or the heteropolymolybdates and heteropolytungstates, or mixtures thereof.

The presence of small amounts of water soluble oxo anions in the sodium borate lubricants is thought to improve the water tolerance of the sodium borates by disrupting the crystal structure of the hydrolysis products. This results in a lower tendency to form crystals or in a reduced rate of crystallization. Thus, such water soluble oxo anions can also be added to the additive packages and finished lubricant compositions of this invention.

It is contemplated that the additive packages of this invention comprising dispersed hydrated sodium borate compositions (described herein) display better storage compatibility and water tolerance in comparison with similar additive packages comprising hydrated potassium borates. Additionally, the finished oil compositions of this invention exhibit improved water tolerance with good high temperature storage stability and compatibility.

The additive packages and lubricant compositions of this invention can further employ surfactants, detergents, other dispersants and other conditions as described below and known to those skilled in the art. Optionally, the additive packages contain an alkylaromatic or polyisobutenyl sulfonate.

The dispersed hydrated sodium borate compositions of this invention generally comprise a dispersant, detergent and oil of lubricating viscosity that are further detailed below.

The Dispersant

The dispersant employed in the compositions of this invention can be ashless dispersants such as an alkenyl succinimide, an alkenyl succinic anhydride, an alkenyl succinate ester, and the like, or mixtures of such dispersants.

Ashless dispersants are broadly divided into several groups. One such group is directed to copolymers which contain a carboxylate ester with one or more additional polar function, including amine, amide, imine, imide, hydroxyl carboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethy methacrylate copolymers and the like. Additionally, high molecular weight amides and polyamides or esters and polyesters such as tetraethylene pentamine, polyvinyl polysterarates and other polystearamides may be employed. Preferred dispersants are N-substituted long chain alkenyl succinimides.

Alkenyl succinimides are usually derived from the reaction of alkenyl succinic acid or anhydride and alkylene polyamines. These compounds are generally considered to have the formula

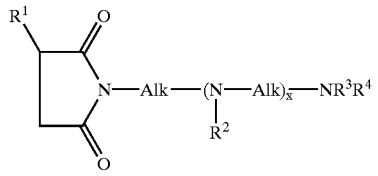

wherein $R^1$ is a substantially hydrocarbon radical having a molecular weight from about 400 to 3000, that is, $R^1$ is a hydrocarbyl radical, preferably an alkenyl radical, containing about 30 to about 200 carbon atoms; Alk is an alkylene radical of 2 to 10, preferably 2 to 6, carbon atoms, $R^2$, $R^3$, and $R^4$ are selected from a $C_1$–$C_4$ alkyl or alkoxy or hydrogen, preferably hydrogen, and x is an integer from 0 to 10, preferably 0 to 3. The actual reaction product of alkylene succinic acid or anhydride and alkylene polyamine will comprise the mixture of compounds including succinamic acids and succinimides. However, it is customary to designate this reaction product as a succinimide of the described formula, since this will be a principal component of the mixture. See, for example, U.S. Pat. Nos. 3,202,678; 3,024,237; and 3,172,892.

These N-substituted alkenyl succinimides can be prepared by reacting maleic anhydride with an olefinic hydrocarbon followed by reacting the resulting alkenyl succinic anhydride with the alkylene polyamine. The $R^1$ radical of the above formula, that is, the alkenyl radical, is preferably derived from a polymer prepared from an olefin monomer containing from 2 to 5 carbon atoms. Thus, the alkenyl radical is obtained by polymerizing an olefin containing from 2 to 5 carbon atoms to form a hydrocarbon having a molecular weight ranging from about 400 to 3000. Such olefin monomers are exemplified by ethylene, propylene, 1-butene, 2-butene, isobutene, and mixtures thereof.

The preferred polyalkylene amines used to prepare the succinimides are of the formula:

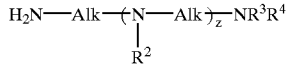

wherein z is an integer of from 0 to 10 and Alk, $R^2$, $R^3$, and $R^4$ are as defined above.

The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl) imidazoline, 1-(2-aminopropyl)-piperazine, 1,4-bis(2-aminoethyl)piperazine and 2-methyl-1-(2-aminobutyl) piperazine. Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898–905 (Interscience Publishers, New York, 1950).

The term "ethylene amine" is used in a generic sense to denote a class of polyamines conforming for the most part to the structure $$H_2N(CH_2CH_2NH)_aH$$

wherein a is an integer from 1 to 10.

Thus, it includes, for example, ethylene diamine, diethylene triamine, triethylene tetraamine, tetraethylene pentamine, pentaethylene hexamine, and the like.

Also included within the term "alkenyl succinimides" are post-treated succinimides such as post-treatment processes involving ethylene carbonate disclosed by Wollenberg, et al., U.S. Pat. No. 4,612,132; Wollenberg, et al., U.S. Pat. No. 4,746,446; and the like as well as other post-treatment processes each of which are incorporated herein by reference in its entirety.

Preferably, the polyalkylene succinimide component comprises from 2 to 40 weight percent, more preferably 10 to 15 weight percent of the weight of the lubricant composition.

Polyalkylene succinic anhydrides or a non-nitrogen containing derivative of the polyalkylene succinic anhydride (such as succinic acids, Group I and/or Group II mono- or di-metal salts of succinic acids, succininate esters formed by the reaction of a polyalkylene succinic anhydride, acid chloride or other derivative with an alcohol, and the like are also suitable dispersants for use in the compositions of this invention.

The polyalkylene succinic anhydride is preferably a polyisobutenyl succinic anhydride. In one preferred embodiment, the polyalkylene succinic anhydride is a polyisobutenyl succinic anhydride having a number average molecular weight of at least 500, more preferably at least 900 to about 3000 and still more preferably from at least about 900 to about 2300.

In another preferred embodiment, a mixture of polyalkylene succinic anhydrides are employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 500 to below 1000 and the high molecular weight component has a number average molecular weight of from 1000 to about 3000. Still more preferably, both the low and high molecular weight components are polyisobutenyl succinic anhydrides. Alternatively, various molecular weights polyalkylene succinic anhydride components can be combined as a dispersant as well as a mixture of the other above referenced dispersants as identified above.

As noted above, the polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112.507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. EP 355 895; terpolymer PIBSA described in U.S. Pat. No. 5,792,729; sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863. The disclosures of each of these documents are incorporated herein by reference in their entirety.

Preferably, the polyalkylene succinic anhydride component comprises from 2 to 40 weight percent, more preferably 10 to 15 weight percent of the weight of the dispersed hydrated sodium borate composition.

Typically, in the dispersed hydrated sodium borate composition, the hydrated sodium borate is in a ratio of at least 2:1 relative to the polyalkylene succinic anhydride dispersant, while preferably being in the range of 2:1 to 10:1. In a more preferred embodiment the ratio is at least 5:2. In another preferred embodiment, mixtures as defined above of the polyalkylene succinic anhydrides are employed.

A particularly preferred combination of dispersants include a mixture of polyalkylene succinic anhydride and a calcium polyisobutenyl sulfonate, especially those made for highly reactive polysiobutylenes. Such mixtures are disclosed, for example, in U.S. patent application Ser. No. 09/967,049, filed concurrently herewith, entitled "Lubricant composition comprising alkali metal borate dispersed in a polyalkylene succinic anhydride and a metal salt of a polyisobutenyl sulfonate", which application is incorporated herein by reference in its entirety.

The Detergent

The compositions of the present invention may optionally contain a detergent. There are a number of materials that are suitable as detergents for the purpose of this invention. These materials include phenates (high overbased or low overbased), high overbased phenate stearates, phenolates, salicylates, phosphonates, thiophosphonates and sulfonates and mixtures thereof. Preferably, sulfonates are used, such as high overbased sulfonates, low overbased sulfonates, or phenoxy sulfonates. In addition the sulfonic acids themselves can also be used.

The sulfonate detergent is preferably an alkali or alkaline earth metal salt of a hydrocarbyl sulfonic acid having from 15 to 200 carbons. Preferably the term "sulfonate" encompasses the salts of sulfonic acid derived from petroleum products. Such acids are well known in the art. They can be obtained by treating petroleum products with sulfuric acid or sulfur trioxide. The acids thus obtained are known as petroleum sulfonic acids and the salts as petroleum sulfonates. Most of the petroleum products which become sulfonated contain an oil-solubilizing hydrocarbon group. Also included within the meaning of "sulfonate" are the salts of sulfonic acids of synthetic alkyl aryl compounds. These acids also are prepared by treating an alkyl aryl compound with sulfuric acid or sulfur trioxide. At least one alkyl substituent of the aryl ring is an oil-solubilizing group, as discussed above. The acids thus obtained are known as alkyl aryl sulfonic acids and the salts as alkyl aryl sulfonates. The sulfonates where the alkyl is straight-chain are the well-known linear alkylaryl sulfonates.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. The sulfonates can then be overbased, although, for purposes of this invention, overbasing is not necessary. Overbased materials and methods of preparing such materials are well known to those skilled in the art. See, for example, LeSuer U.S. Pat. No. 3,496,105, issued Feb. 17, 1970, particularly Cols. 3 and 4.

The sulfonates are present in the lubricating oil composition in the form of alkali and/or alkaline earth metal salts, or mixtures thereof. The alkali metals include lithium, sodium and potassium. The alkaline earth metals include magnesium, calcium and barium, of which the latter two are preferred.

Particularly preferred, however, because of their wide availability, are salts of the petroleum sulfonic acids, particularly the petroleum sulfonic acids which are obtained by sulfonating various hydrocarbon fractions such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid which may or may not be alkylated; and the like.

The preferred salts for use in the present invention are those of alkylated aromatic sulfonic acids in which the alkyl radical or radicals contain at least about 8 carbon atoms, for example from about 8 to 22 carbon atoms. Another preferred group of sulfonate starting materials are the aliphatic-substituted cyclic sulfonic acids in which the aliphatic substituents or substituents contain a total of at least 12 carbon atoms, such as the alkyl aryl sulfonic acids, alkyl cycloaliphatic sulfonic acids, the alkyl heterocyclic sulfonic acids and aliphatic sulfonic acids in which the aliphatic radical or radicals contain a total of at least 12 carbon atoms. Specific exarnples of these oil-soluble sulfonic acids include petroleum sulfonic acid, petrolatum sulfonic acids, mono- and poly-wax-substituted naphthalene sulfonic acids, substituted sulfonic acids, such as cetyl benzene sulfonic acids, cetyl phenyl sulfonic acids, and the like, aliphatic sulfonic acid, such as paraffin wax sulfonic acids, hydroxy-substituted paraffin wax sulfonic acids, etc., cycloaliphatic sulfonic acids, petroleum naphthalene sulfonic acids, cetyl cyclopentyl sulfonic acid, mono- and poly-wax-substituted cyclohexyl sulfonic acids, and the like. The term "petroleum sulfonic acids" is intended to cover all sulfonic acids that are derived directly from petroleum products.

Typical Group II metal sulfonates suitable for use in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc. The concentration of metal sulfonate that may be employed may vary over a wide range, depending upon the concentration of sodium borate particles. Generally, however, the concentration may range from 0.2 to about 10 weight percent and preferably from 3 to 7 weight percent. In addition, the compositions of this invention may contain a mixture of both a metal sulfonate and an ashless dispersant, as described above, where the ratio is a factor of achieving the proper water tolerance properties of the borate final product.

The Oil of Lubricating Viscosity

The lubricating oil to which the hydrated sodium borates and the dispersant are added can be any hydrocarbon-based lubricating oil or a synthetic base oil stock. Likewise, these lubricating oils can be added to the dispersed sodium borate compositions and additive packages containing them, as described herein, to form finished oil compositions. The hydrocarbon-based lubricating oils may be derived from synthetic or natural sources and may be paraffinic, naphthetic or asphaltenic base, or mixtures thereof. The diluent oil can be natural or synthetic, and can be different viscosity grades.

The lubricating oil comprises from 30 to 70 weight percent, more preferably from 45 to 55 weight percent, based on the total weight of the dispersed hydrated sodium borate composition.

Formulations

The dispersed hydrated sodium borate compositions of the present invention (as described herein above) are generally blended to form additive packages comprising such dispersed hydrated sodium borate compositions. These additive packages typically comprise from about 10 to 75 weight percent of the dispersed hydrated sodium borate composition described above and from about 90 to 25 weight percent of one or more of conventional additives selected from the group consisting of ashless dispersants (0–5%), detergents (0–2%), sulfurized hydrocarbons (0–30%), dialkyl hydrogen phosphates (0–10%), zinc dithiophosphates (0–20%), dialkyl hydrogen phosphates (0–10%), pentaerythritol monooleate (0–10%), 2,5-dimercaptothiadiazole (0–5%), benzotriazole (0–5%), dispersed molybdenum disulfide (0–5%), imidazolines (0–10%), and foam inhibitors (0–2%) and the like wherein each weight percent is based on the total weight of the composition.

Fully formulated finished oil compositions of this invention can be formulated from these additive packages upon further blending with an oil of lubricating viscosity. Preferably, the additive package described above is added to an oil of lubricating viscosity in an amount of from about 5 to 15 weight percent to provide for the finished oil composition wherein the weight percent of the additive package is based on the total weight of the composition. More preferably, added along with the oil of lubricating viscosity is a polymethacrylate viscosity index improver which is included at a level of 0–12% and/or a pour point depressant at a level of 0–1%, to form a finished oil wherein the weight percent of each of the viscosity index improver and pour point depressant is based on the total weight of the composition.

A variety of other additives can be present in lubricating oils of the present invention. Those additives include antioxidants, rust inhibitors, corrosion inhibitors, extreme pressure agents, antifoam agents, other viscosity index improvers, other anti-wear agents, and a variety of other well-known additives in the art.

EXAMPLES

The invention will be further illustrated by the following examples, which set forth particularly advantageous method embodiments. While the examples are provided to illustrate the present invention, they are not intended to limit it.

As used herein, the following abbreviations have the following meanings. If not defined, the abbreviation will have its art recognized meaning.

cSt=centistokes g=gram

IR=infra-red

LOB=low overbased

M=metal mm=millimeters mL=milliliter

Mn or $M_n$=number average molecular weight

NTU or ntu=nephelometric turbidity unit

PIB=polyisobutylene

PIBSA=polyisobutenyl succinic anhydride

PSD=particle size distribution

TBN=total base number vis=viscosity

Example 1

The dispersed hydrated sodium borate compositions of this invention generally can be prepared by dehydrating a water-in-oil emulsion of an aqueous solution of sodium hydroxide and boric acid. Preferably a solution is prepared having a boron to sodium ratio of 3 to 1. This solution is then added to a combination of neutral oil, dispersant, and/or a detergent and mixed to form an emulsion. The resulting emulsion is heated to partially dehydrate it. Reduced pressures can also be used and the temperature set accordingly. During dehydration of the emulsion there is an initial period when water is removed from the emulsion at a rapid rate at a constant temperature for example at about 102° C. After this period, nearly all process water has been eliminated and water removed after this stage is due to the dehydration of the hydrated borate oligomer. Then the temperature slowly increases and the emulsion changes from turbid to clear. As the degree of dehydration and temperature continue to increase, the resulting liquid will again become turbid. As used in these examples, the following equipment was used to measure the experimental data:

Turbidity: Turbidity of the finished oils was measured, neat, at 20° C. using a Hach Ratio Turbidimeter Model: 18900. The turbidimeter was calibrated with 18 and 180 ntu Formazin primary standards.

Total Base Number (TBN): TBN's were measured by ASTM method D2896 using a Brinkmann 682 Titroprocessor.

Particle Size Distribution (PSD): Particle size distributions were measured on a Horiba LA-920 Particle Size Analyzer running Horiba LA-920 software with the relative refractive index set at "126A000I." GC grade n-heptane was used as the dispersant fluid.

Dispersed Hydrated Sodium Borate Compositions:

Four dispersed hydrated dispersed sodium borate compositions (1A–1D, see Table 1) were prepared by dehydration of oil-in-water emulsions of aqueous sodium borate and dispersant/detergent oil solutions by heating them to 250° F. and 270° F. over about 1.5 hours and 3.25 hours each. The aqueous solutions were prepared in 2 liter glass beakers by stirring and heating mixtures of: 136.4 g of deionized water, 109.8 g of 99.5% Boric Acid (EMScience), 46.8 g of 50% Sodium Hydroxide in water (VWR), and 0.30 g of 99.5% Sodium Carbonate (EMScience), until the boric acid completely dissolved. Oil-in-water emulsions were made by gradually adding the aqueous phase to an oil phase containing: 136.15 g of Exxon 150 Neutral oil, a group I base oil, 30.25 g of an alkenyl succinate having a molecular weight of about 1100 amu, and 13.25 g of a neutral calcium sulfonate having a TBN of about 5 mgKOH/g, under a vigorous mixing action. A high shear mixer is preferred to form an emulsion or a micro-emulsion. The emulsions were then dehydrated in a 1-liter stainless steel kettle equipped with a mechanical stirrer, heat mantle, temperature controller, and nitrogen sweep line. The four batches were heated over different lengths of time to 250° F. or 270° F., thus determining several different dehydration conditions.

Table 1 contains the OH:B ratio and turbidity data for four preparations of sodium borate dispersions. These preparations were made with different heating rates and final dehydration temperatures. As indicated by the data, samples dehydrated to 250° F. over about 3 hours and to 270° F. over about 1.75 hours have lower turbidity than the samples dehydrated to 250° C. over 1.5 hours and 270° C. over 3.5 hours. Turbidity and the resulting OH:B ratio are a function of the process conditions undertaken during dehydration.

TABLE 1

Process Conditions, Turbidity and OH:B ratio Data

| Sample | Final Temp, ° F. | Time, hours | Turbidity, ntu | OH:B ratio |
|---|---|---|---|---|
| 1A | 250 | 1.5 | 96 | 1.61:1 |
| 1B | 270 | 1.75 | 29 | 0.99:1 |
| 1C | 250 | 3 | 47 | 1.43:1 |
| 1D | 270 | 3.5 | 66 | 0.81:1 |

Dehydration Monitored by In-situ Infra-red (IR) Measurement:

IR data was collected using an in-situ probe during the dehydration of an emulsion, prepared in the same manner as examples 1A–D. The kettle was equipped with an in situ ReactIR MP mobile IR probe manufactured by Applied Systems Inc.; the probe is a six reflection diamond coated ZnSe ATR element. An IR spectrum was collected every minute using ReactIR software, also manufactured by Applied Systems Inc., so that peak heights/areas could be tracked over the course of the reaction. These peak heights/areas were then plotted over time. FIG. 1 illustrates the overlaid IR spectra obtained during dehydration of the sodium dispersion, (generated by ReactIR). Samples were taken at various times during dehydration. Turbidity was measured and OH:B ratio was calculated as shown above.

The samples were analyzed for particle size distribution, turbidity, OH:B ratio, and TBN with turbidity and OH:B ratio presented in Table 2.

TABLE 2

Turbidity and OH:B Data

| Sample | Turbidity, ntu | OH:B ratio |
|---|---|---|
| 1E | 200 | 2.18:1 |
| 1F | 77 | 1.57:1 |
| 1G | 24 | 1.38:1 |
| 1H | 14.6 | 1.28:1 |
| 1I | 11.5 | 1.21:1 |
| 1J | 14.6 | 1.10:1 |
| 1K | 20 | 1.02:1 |
| 1L | 34 | 0.91:1 |
| 1M | 51 | 0.84:1 |
| 1N | 62 | 0.72:1 |

Figure 2:
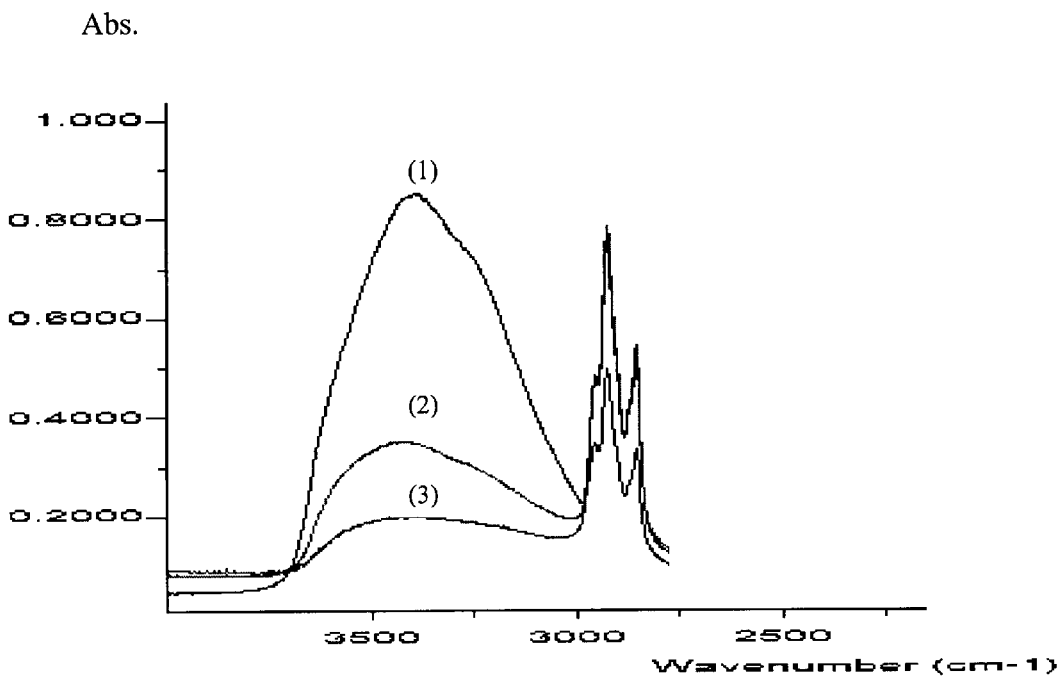
FIG. 2 represents an infra-red overlay spectrum in the region of from 4000 $cm^{-1}$ to 3000 $cm^{-1}$ as: (1) taken initially; (2) at the point of low turbidity; and (3) at the end of the dehydration run, for a hydrated sodium borate of this invention.

The absorbance of the IR spectrum in the region of 4000 $cm^{-1}$ to 3000 $cm^{-1}$, is shown in FIG. 2. FIG. 2 illustrates the hydroxyl groups of the hydrated sodium borate dispersion over the dehydration run: for example, plot (1) illustrates the IR spectrum at the beginning of the reaction; plot (2) illustrates the IR spectrum at the low point of the turbidity, shown at the elevated temperatures of the dehydration (2.75 hrs); and plot (3) illustrates the IR spectrum at the end of the dehydration run.

Figure 3:
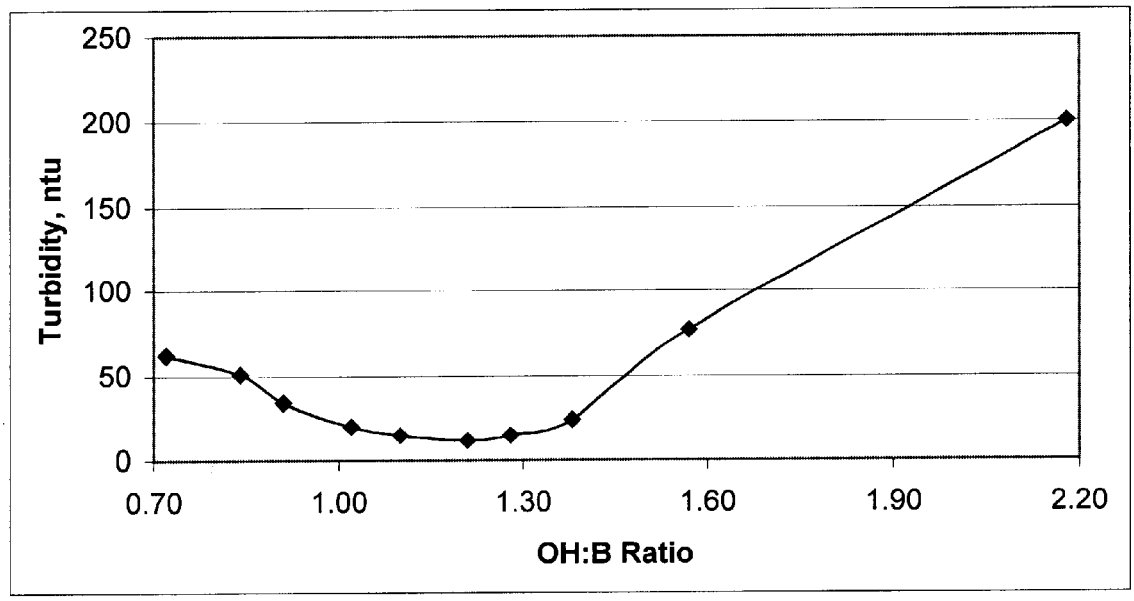
FIG. 3 shows that the turbidity of the dispersed hydrated sodium borate composition reaches a minimum at an OH:B ratio of between about 0.80:1 to 1.60:1.

FIG. 3 graphically illustrates the turbidity as a function of the OH:B ratio, using the data in Table 2, showing an inflection point of minimum turbidity at an OH:B ratio of about 1.2:1 to 1:1. Turbidity can be seen to decrease during the course of the dehydration reaction and then increase after passing a minimum. Products prepared by controlling the dehydration endpoint after this point of low turbidity at the elevated dehydration temperature, are seen to approach a minimum turbidity when the OH:B ratio was kept between about 0.8:1 and 1.60:1. As shown in FIG. 3, the turbidity is low over a specific OH:B range and is a minimum at an OH:B ratio of about 1:1 to about 1.3:1. This minimum inflection in the chart can be related to an OH:B ratio range and results in a homogeneous dispersion for the resulting mixture. While it is expected that the dispersant type and additives may affect the shape of the curve shown in FIG. 3, or the specific OH:B ratio values which results in a minimum turbidity, the desired range can determined by the methods herein.

While a point of low turbidity is observed at elevated dehydration temperature, it does not correlate to the point of low turbidity in the dispersed hydrated sodium borate composition at the desired ambient temperature of 0–50 C. To achieve improved turbidity of the dispersed hydrated sodium borate composition at this temperature or at ambient temperature, additional dehydration must continue until the emulsion again becomes turbid. This increment of additional dehydration has been back calculated to achieve the desired results in the emulsion at the temperature of concern.

Continued dehydration after the point of low turbidity, results in a higher turbidity. Continued dehydration will eventually result in precipitation and sedimentation of the borate.

Potassium Borate Dispersions

Following the procedures set forth above for the preparation of hydrated sodium borate, hydrated potassium borate dispersions were prepared. However, these compositions were prepared using 74.15 g of 45% potassium hydroxide in water (from EMScience 88.5% pellets) used in place of sodium hydroxide, while an alkenyl succinimide having a molecular weight of about 1300, was used instead of the alkenyl succinate, and sodium carbonate was not used. The emulsions were dehydrated in a 1-liter stainless steel kettle equipped with a mechanical stirrer, heat mantle, temperature controller, and nitrogen line. The kettle was also equipped with an in situ ReactIR MP mobile IR probe manufactured by Applied Systems Inc.; the probe is a six reflection diamond coated ZnSe ATR element. The emulsions were brought to a final temperature of approximately 132° C. over about 3.75 hours under a nitrogen sweep, with mechanical stirring. An IR spectrum was collected every 10 minutes. Samples were taken starting at about 115° C. (2.5 hours) until the end of the dehydration. The samples were analyzed for particle size distribution, turbidity, and TBN. This potassium borate product was tested for water tolerance.

Example 2

Water tolerance as a function of the OH:B ratio has been found to behave similarly as that found for turbidity as a function of the OH:B ratio. The dispersed hydrated sodium borate compositions of this invention were compared to the potassium borate compositions prepared above by formulating them into comparable finished oil compositions and subjecting them to water contamination at elevated temperatures. We first blended the borate lubricating compositions of the present invention at a dosage of about 46% into a typical additive package comprising, ashless dispersant, calcium sulfonate, corrosion inhibitor, EP agent, friction modifier, multifunctional additives, metal deactivator, etc. This additive package was then added at the level of 6.5% to diluent oil to make an 80W90 finished oil formulation. This formulation was then run in the Coordinating Research Counsel L-33 test to test water tolerance; see U.S. Pat. No. 4,089,790 incorporated herein by reference. This test evaluates lubricant performance by exposure of the lubricant to a severe environment. Performance is based upon deposit and rust conditions within the test equipment as well as the condition of the lubricant upon completion of the test. In this test, 1.2 liters of test lubricant are placed in a bench-mounted automotive differential assembly and water, 30 milliliters is added, thus simulating a type of severe filed service in which corrosion promoting moisture in the form of condensed water vapor has accumulated in the axle assembly. This test has been determined to correlate to field service.

TABLE 3

Water Tolerance Data

| Borate Type | OH:B ratio | L33 Deposits, Area % |
|---|---|---|
| Potassium | nd | 28 |
| Sodium | 1.25:1 | 2 |
| Sodium | 1.14:1 | 3 |
| Sodium | 0.94:1 | 2 |
| Sodium | 0.88:1 | 9 |
| Sodium | 0.70:1 | 9 |

L33 deposits, area %, are the percentage of the differential housing and parts covered with deposits, as determined by the prescribed method. The result of this test illustrate that water tolerance for hydrated sodium borate compositions of this invention is a function of the OH:B ratio. The water tolerance for these sodium metal borates, as measured by a decrease in L-33 Deposits, Area %, is optimum when the OH:B ratio is about 0.90:1 to 1.50:1. At a OH:B ratio of less than 0.90:1, the water tolerance is a little bit worse but still better than the water tolerance for the potassium borate. The sodium borate with an OH:B ratio of 0.70:1 had the same water tolerance as the sodium borate with an OH:B ratio of 0.88:1 but the turbidity was not as good. As Table 3 illustrates, the preferred OH:B ratio values that give good water tolerance correspond with the preferred OH:B ratio values that gave good turbidity as stated above.

Example 3

The following example compares the stability of two dispersed hydrated sodium borate compositions prepared using about 13 weight percent of a polyisobutenyl succinic anhydride, about 5 weight percent of a 5 TBN natural sulfonate, and a base oil in the manner of Example 1 above. The first dispersed hydrated sodium borate had a sodium:boron ratio of 1:2.44 and the second had a sodium:boron ratio of 1:3.00.

The samples were maintained under ambient conditions in sealed containers. They were not exposed to atmospheric moisture. After about twenty-four hours (without any contamination), crystals had formed in the first hydrated sodium borate, but had not in the second hydrated sodium borate. In fact, no visible crystal formation has been observed in any samples of dispersed sodium borate having Na:B ratios within the claimed range over periods of up to one year at ambient conditions.

From the foregoing description, various modifications and changes in the above described invention will occur to those skilled in the art. All such modifications coming within the scope of the appended claims are intended to be included therein.

What is claimed is:

1. A dispersed hydrated sodium borate composition comprising a hydrated sodium borate, a dispersant, and an oil of lubricating viscosity wherein said hydrated sodium borate is characterized by a hydroxyl:boron ratio (OH:B) of from about 0.80:1 to 1.60:1 and by a sodium to boron ratio of from about 1:2.75 to 1:3.25.

2. The composition according to claim 1, wherein the dispersed hydrated sodium borate has a sodium to boron ratio of from about 1:2.9 to about 1:3.1.

3. The composition according to claim 1, wherein the dispersed hydrated sodium borate has a sodium to boron ratio of about 1:3.

4. The composition according to claim 1, wherein the dispersed hydrated sodium borate has a hydroxyl to boron ratio of from about 0.90:1 to 1.50:1.

5. The composition according to claim 1, wherein the dispersed hydrated sodium borate has a hydroxyl to boron ratio of from about 1.00:1 to 1.40:1.

6. The composition according to claim 1 wherein said composition further comprises from about 0.001 moles to about 0.11 moles of a water soluble oxo anion per mole of boron.

7. The composition according to claim 6 wherein said water-soluble oxo anion is selected from the group consisting of nitrate, sulfate, carbonate, phosphate, pyrophosphate, silicate, aluminate, germanate, stannate, zincate, plumbate, titanate, molybdate, tungstate, vanadate, niobate, tantalate, uranates, isopolymolybdates, isopolytungstates, heteropolymolybdates, heteropolytungstates, and mixtures thereof.

8. The composition according to claim 1 wherein said dispersant is selected from the group consisting of a polyalkylene succinimide, a polyalkyene succinic anhydride, a polyalkylene succinic acid, a mono- or di-salt of a polyalkylene succinic acid and mixtures thereof.

9. The composition according to claim 1 wherein said composition further comprises 0.2 to 10 weight percent of a detergent based upon the total weight of the composition.

10. An additive package comprising:

(a) from about 10 to 75 weight percent of the dispersed hydrated sodium borate composition according to claim 1; and (b) from about 25 to 90 weight percent of one or more of additives selected from the group consisting of ashless dispersants, detergents, sulfurized hydrocarbons, dialkyl hydrogen phosphates, zinc dithiophosphates, dialkyl hydrogen phosphates, pentaerythritol monooleate, 2,5-dimercapto thiadiazole, benzotriazole, dispersed molybdenum disulfide, foam inhibitors, and imidazolines; wherein the weight percent of each component is based on the total weight of the composition.

11. A finished oil composition comprising:

a. from about 5 to 15 weight percent of the additive package of claim 10; and b. from about 85 to 95 weight percent of an oil of lubricating viscosity, wherein the weight percent of each component is based on the total weight of the composition.

12. The finished oil composition according to claim 11, which further comprises at least one of a polymethacrylate viscosity index improver and a pour point depressant.

13. A method for providing lower turbidity for oil compositions comprising a sodium metal borate and a dispersant which method comprises forming a dispersed hydrated sodium borate composition with an oil of lubricating viscosity, a dispersant and an anti-wear effective amount of a hydrated sodium borate wherein said dispersed hydrated sodium borate composition is selected to have a hydroxyl:boron ratio (OH:B) of from about 0.80:1 to 1.60:1 and a sodium to boron ratio of from about 1:2.75 to 1:3.25.

14. A method for the preparation of a dispersed hydrated sodium borate composition which comprises:

(1) mixing, under agitation, a mixture comprising:

(a) an aqueous solution of boric acid and sodium hydroxide wherein the stoichiometric ratio of reagents are selected to provide for a sodium to boron ratio in the product of from about 1:2.75 to 1:3.25, (b) an oil of lubricating viscosity; and (c) a dispersant; and then, (2) heating the mixture to remove sufficient water so as to produce a dispersed hydrated sodium borate having a hydroxyl:boron ratio (OH:B) of from about 0.80:1 to 1.60:1.

* * * * *